United States Patent [19]

Horgan, Jr.

[11] 4,418,949

[45] Dec. 6, 1983

[54] PANIC HANDLE FOR DOORS

[75] Inventor: William J. Horgan, Jr., Pittsburgh, Pa.

[73] Assignee: Blumcraft of Pittsburgh, Pittsburgh, Pa.

[21] Appl. No.: 468,134

[22] Filed: Feb. 22, 1983

Related U.S. Application Data

[63] Continuation-in-part of Ser. No. 185,375, Sep. 8, 1980, which is a continuation-in-part of Ser. No. 152,403, May 22, 1980, Pat. No. 4,366,974.

[51] Int. Cl.[3] ..... E05C 15/02

[52] U.S. Cl. ..... 292/92; 292/336.3; 292/DIG. 57; 292/DIG. 73

[58] Field of Search ..... 292/92, DIG. 57, DIG. 73, 292/336.3, 21, 93, 166, 173, DIG. 60

[56] References Cited

U.S. PATENT DOCUMENTS

| | | | |
|---|---|---|---|
| 2,012,926 | 8/1935 | Golden | 292/DIG. 73 |
| 3,464,728 | 9/1969 | Ruckel et al. | 292/92 |
| 3,663,047 | 5/1972 | Zawadyki | 292/92 |
| 3,696,648 | 10/1972 | Horgon, Jr. | 292/DIG. 57 X |
| 4,083,590 | 4/1978 | Folger | 292/92 |
| 4,366,974 | 1/1983 | Horgon, Jr. | 292/92 X |
| 4,382,620 | 5/1983 | Horgon, Jr. | 292/92 |

*Primary Examiner*—Richard E. Moore
*Attorney, Agent, or Firm*—Paul & Paul

[57] ABSTRACT

The present invention provides a combination door and panic handle for use on the interior side of entrance doors. In one mode of operation the panic handle may be moved inwards toward the door face to unlatch the door. In this mode of operation the door may be opened on the exterior side by use of a key. In an alternative mode of operation, the panic handle is "locked-out" and prevented from moving. In this mode of operation the door is unlatched and the panic handle may be used as a fixed door handle. In the movable mode of operation, pressure may be applied along any portion of the panic handle to facilitate unlatching the door. The operating mechanism of the panic handle is concealed presenting a smooth uncluttered appearance. A new anti-rattle and sound deadening feature is also provided for the latch mechanism, and a particularly unique adjustment feature for in-field adjustment of latch length extension is also provided.

4 Claims, 9 Drawing Figures

PANIC HANDLE FOR DOORS

RELATIONSHIP TO OTHER APPLICATION

This application is continuation-in-part of my earlier application entitled *Panic Handle For Doors,* Ser. No. 185,375, filed Sept. 8, 1980, which in turn is a continuation-in-part of my earlier application entitled *Panic Handle For Doors,* Ser. No. 152,403, filed May 22, 1980, now U.S. Pat. No. 4,366,974, issued Jan. 4, 1983.

BRIEF SUMMARY OF THE INVENTION

According to the present invention there is provided a combination door and panic handle for use with entrance doors. In one mode of operation the panic handle is movable to facilitate unlatching the door when pressure is applied towards the door at any point along the surface of the panic handle. The panic handle may, alternatively, be dogged in its most inward position which permanently unlatches the door. In this mode of operation the panic handle is used as a stationary door handle. The door may be opened from the exterior side, when latched, by use of a key. A fixed exterior handle is located adjacent to a segment of the interior panic handle to provide a symmetrical appearance. When used on a glass door, the exterior and interior handles appear as one continuous handle. An anti-rattle and sound deadening feature is provided, as is an adjustment for latch length.

DETAILED DESCRIPTION OF THE PREFERRED EMBODIMENT

Figure 1:
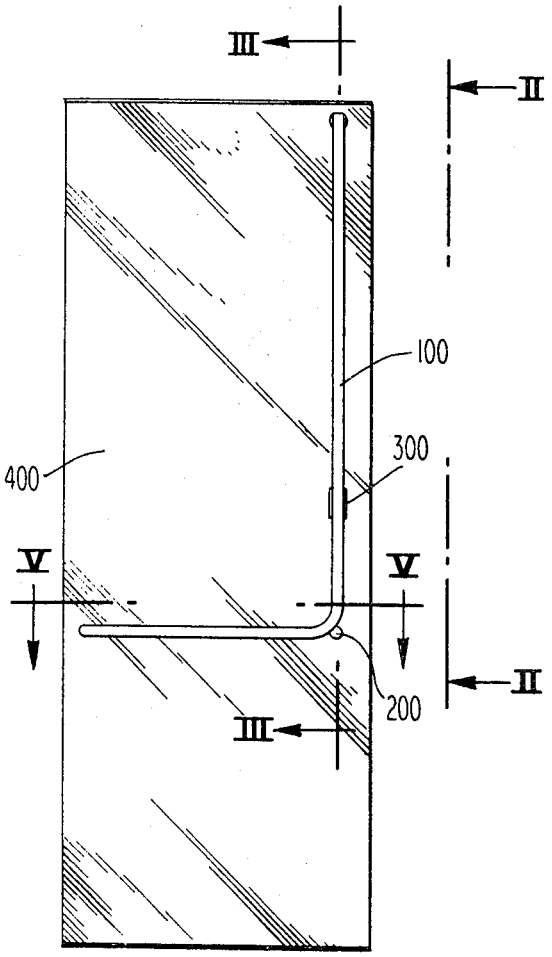
FIG. 1 is a plan view of a typical panic handle installed on a rectangular door.
Figure 2:
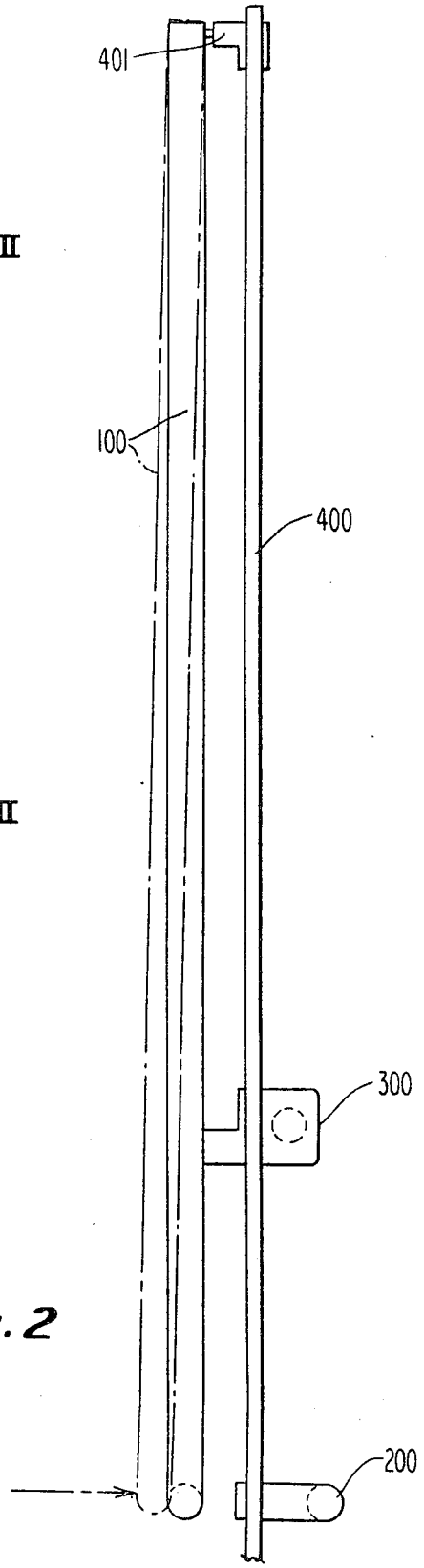
FIG. 2 is a side view of the door and panic handle combination illustrating the relative motion of the panic handle in its outer (latched) position and inner (unlatched) position.

FIGS. 1 and 2 schematically illustrate the appearance of the panic handle for the present invention. Of course, it will be understood that many alternative configurations could be used for this panic handle and that the embodiment shown is by way of illustration. As shown, the panic handle is mounted at each of its ends to the interior of the door. As shown in FIG. 2, the handle is susceptible of limited motion toward and away from the door, although, of course, the end points of the panic bar furthest from the mounting points is capable of sufficient motion to facilitate latching and unlatching the door as will be discussed below. As shown in FIGS. 1 and 2, panic bar assembly 100 is movably mounted to the interior of door assembly 400. Panic bar assembly 100 engages stationary actuator post assembly 300 as shown. An optional exterior handle assembly 200, may be fixed to the exterior portion of door 400.

Figure 4:
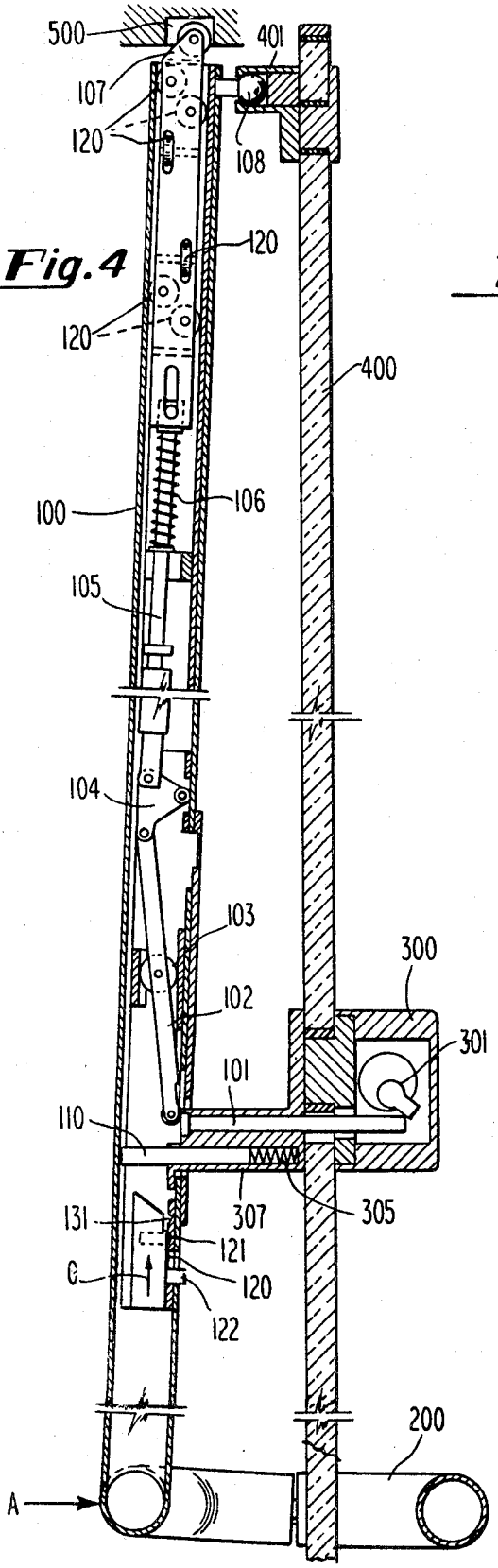
FIG. 4 is a view like FIG. 3, of the door and panic handle mechanism, but shown in the latched position.
Figure 3:
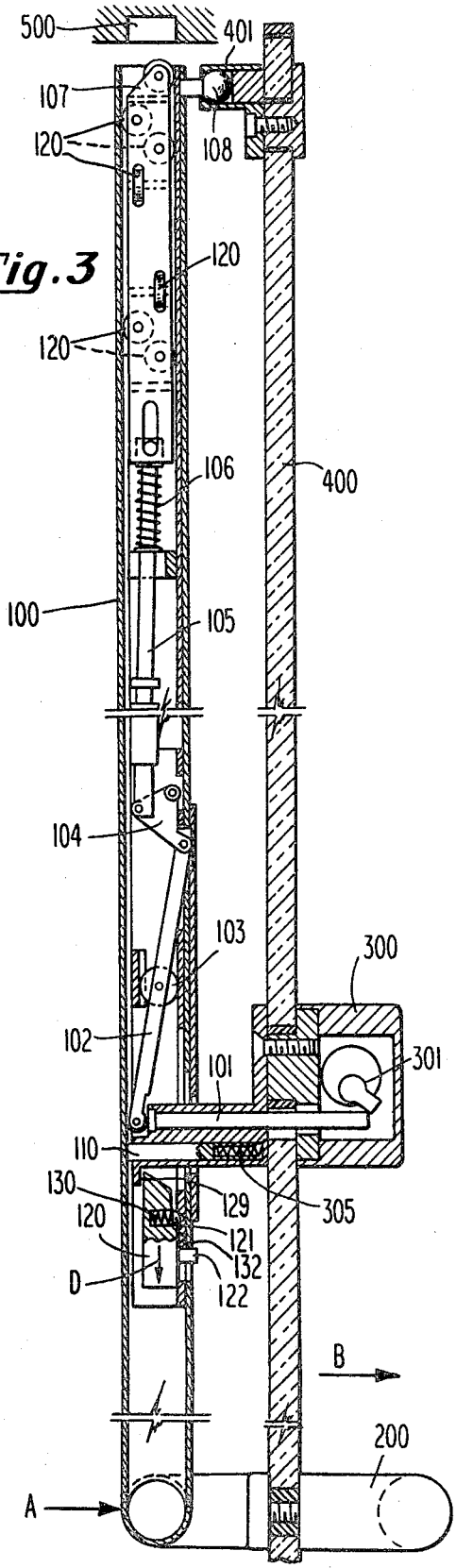
FIG. 3 is a vertical sectional view taken along the lines III—III of FIG. 1, with the door and panic handle mechanism shown in the unlatched position.

Referring now to FIGS. 3 and 4, the overall operation of the panic handle of this invention will be described. As shown in FIG. 4, the panic handle is in the latched position. As illustrated, latch bolt 107 engages latching recess 500 which secures the door assembly 400 in the locked position. The door is unlatched when a force is applied to the panic handle in the direction illustrated in FIGS. 3 and 4 by arrows "A", it being appreciated that this force may be applied almost anywhere along the surface of panic bar assembly 100. A force applied to the panic bar in the direction "A" illustrated initiates the sequence of events which automatically unlatch latch bolt 107 allowing door assembly 400 to move in the direction illustrated by arrow "B" of FIG. 3. As panic bar assembly 100 moves toward door assembly 400, the stationary actuator post assembly 300 penetrates the panic bar assembly as shown and through a series of lever arms effectuates withdrawl of latch bolt 107. Specifically, as the panic bar assembly moves towards the door, lever arm 102 changes position as shown in reaction to the force applied by the end of the stationary actuator post assembly which penetrates the panic bar assembly. This motion of lever arm 102 causes the over-center mechanism 104 to change positions, as shown, which in turn moves bar 105 downwardly, as shown, ultimately withdrawing latch bolt 107 into the end of panic bar assembly 100 unlatching the door. Springs 305 and 106 against sliding guide bar 110 and latch bolt 107 facilitate restoring the panic bar to the latched position, away from the door, when exterior force "A" is removed.

Dog mechanism assembly 120 facilitates locking the panic bar assembly in its most inward position towards the door which has the effect of permanently unlatching the door. In this position, the panic handle becomes a stationary door handle. As illustrated, dog assembly 120 may be moved upward by use of slide member 122 to engage the inward lip of 129 of the stationary actuator post assembly 300 securing the handle in the unlatched position. Detent locking member 121 is spring loaded at 130 and secures the dogging mechanism 120 in either the dogged or undogged position by engaging in detents 131 or 132 upon movement of slide member 122 upwardly or downwardly as shown by arrows "C" and "D" respectively.

A locking mechanism is illustrated schematically at 301. This locking mechanism is useful to open the door from the exterior side when the door is latched. Of course, it is not necessary to unlock the door when it is unlatched and, accordingly, as shown in FIG. 3, key actuated mechanism (or magnetic card or combination actuated mechanism) 301 is ineffective when the door is in the unlatched position. When the door is in the latched position, as shown in FIG. 4, turning the key member in key mechanism 301, as illustrated schematically, moves assembly 101 to the left, as illustrated in FIG. 4, engaging lever arm 102 and, initiating the sequence of events described above which ultimately unlatches the door.

Figure 5:
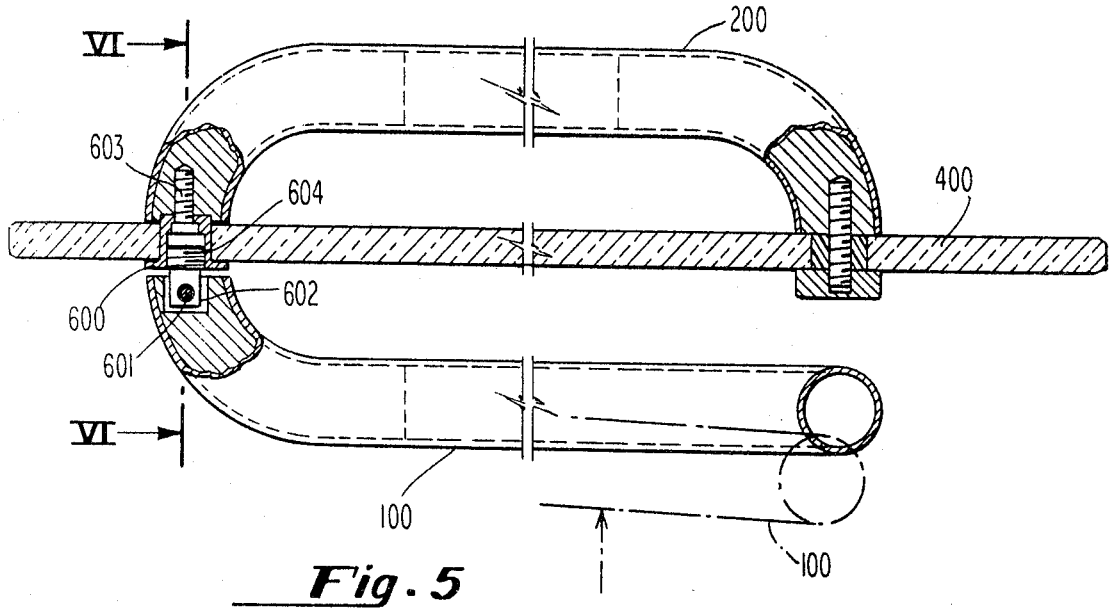
FIG. 5 is a transverse sectional view of the door and panic handle and exterior fixed handle, taken along lines V—V of FIG. 1.
Figure 6:
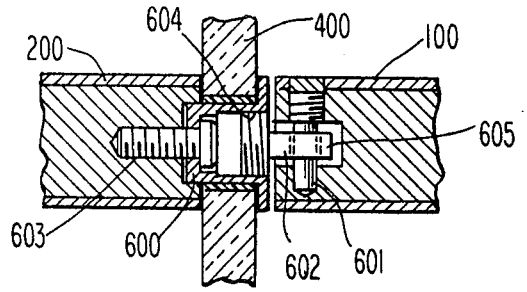
FIG. 6 is a vertical sectional view of the mounting means used to secure one end of the fixed exterior handle and one end of the movable panic handle to the door, taken along lines VI—VI of FIG. 5.

As has been described, panic handle assembly 100 is pivotally mounted to door assembly 401 in such a manner that the panic handle is free to move sufficiently to allow interaction with the stationary handle actuator post 300 to latch and unlatch the door. FIGS. 5 and 6 illustrate one possible mechanism for achieving said mounting although it will be appreciated that many alternative designs could be employed. As shown in FIGS. 5 and 6, mounting hardware can be employed which secures one end of exterior handle 200 to glass door 400 in conjunction with mounting apparatus used to secure one end of panic handle assembly 100 to glass door 400. The effect of using this harware arrangement in conjunction with a glass door is aesthetically pleasing because the fixed exterior handle and movable interior panic handle appear to be one continuous unit. Handle mounting assembly 600 rigidly secures exterior handle 200 to door 400 by use of threaded bolt 603. The interior panic handle assembly 100 is pivotally secured to door 400 by means of pivot boss 602 movably threaded into assembly 600 at 604 and pivot pin 601 engaged through boss 602 to handle 100 as shown in FIG. 6. It will be appreciated that this assembly allows panic handle assembly 100 to move freely about pivot pin 601 and also allows a very limited degree of motion by rotation of threaded boss 602 in threads 604 when the handle is moved from the exterior to interior positions and vice versa.

Figure 7:
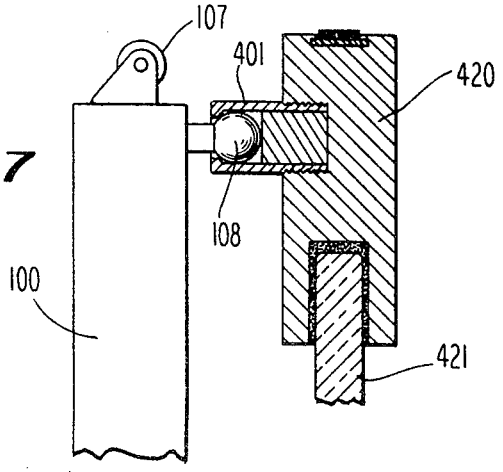
FIG. 7 is a vertical sectional view of an alternative mounting means used to secure the end of the panic handle adjacent the door latch to the door frame assembly.

FIG. 7 illustrates an embodiment of a panic bar assembly mounting used to secure the bar to the frame 420 of a door adjacent the latch assembly. As shown, mounting assembly 401 is secured to the outer frame 420 of door assembly 400. Of course, alternative configurations of mounting bracket and door assembly can be employed without departing from the spirit of this invention and, accordingly, FIGS. 3 and 4 illustrate variations of door style and configuration and mounting bracket in direct engagement with the glass of the door. All configurations represented by drawings 1 through 7 employ ball-shaped member 108 in conjunction with a cylindrical support mechanism the effect of which allows latch bolt 107 to be precisely located for engagement with latch 500 while allowing panic handle assembly 100 to pivot slightly as the panic handle is moved toward or away from the door.

Figure 8:
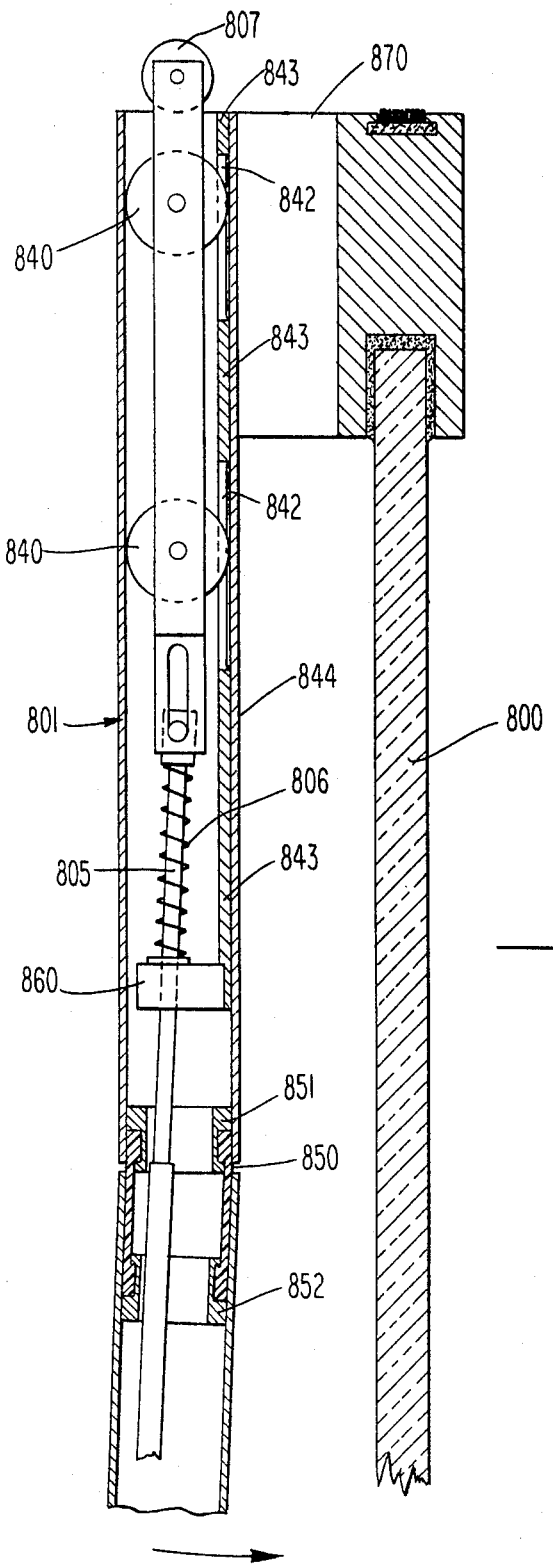
FIG. 8 is a vertical sectional view of another embodiment of a panic handle, taken along a line similar to that III—III of FIG. 1.

An alternative configuration is illustrated in FIG. 8. As shown, the top of panic bar assembly 801 is rigidly fixed to door assembly 800 by mounting bracket 870. In this configuration panic bar 801 is divided into two rigid pieces joined together by an internal rubber sleeve 850 with the lower piece being pivotally movable relative to the upper piece. As shown in FIG. 8, this pivot point is located somewhat lower than the pivot point of the configurations illustrated in FIGS. 1 through 7. Nevertheless, the relative motion of the movable part of the panic bar 801 is quite small; and accordingly, linkage 805 and other linkage members 806 and 860 are substantially as illustrated in FIGS. 3 and 4.

It is important that latch bolt 107 be able to extend freely into engagement with latch 500 without any excess play or free motion of the latching mechanism within panic bar assembly 100. To facilitate this, as shown in FIGS. 3 and 4, inner wheels 120 securely engage the inner surface of panic bar assembly 100 while allowing free motion of the latch assembly. The axles of said inner wheels are oriented in different directions, as shown, to constrain excess play in all directions. An alternative mechanism which achieves the same effect is shown in FIG. 8. In this configuration two wheels 840 ride within slots 842 which run parallel to the inner surface panic bar assembly 801 and are located in a vertical plate 843 carried along the right wall 844 of assembly 801. Wheels 840 are sized such that they securely engage the inner surface of one side of panic bar assembly 801 and fit securely into slot 842 on the opposite side of panic bar assembly 801. This assures that the latch assembly will have a minimum of play while at the same time being able to move freely as required when latching and unlatching the door mechanism.

As shown in FIG. 8, panic bar assembly 801 pivots slightly when the panic handle is depressed about rubber coupling 850. The coupling 850 is held in place by internal sleeves 851 and 852 as shown. The small gap between segments of panic bar assembly 801 which occur about sleeve 850 are just sufficient to allow slight motions of the movable portions of panic bar assembly 801 while retaining a smooth finished appearance.

Figure 9:
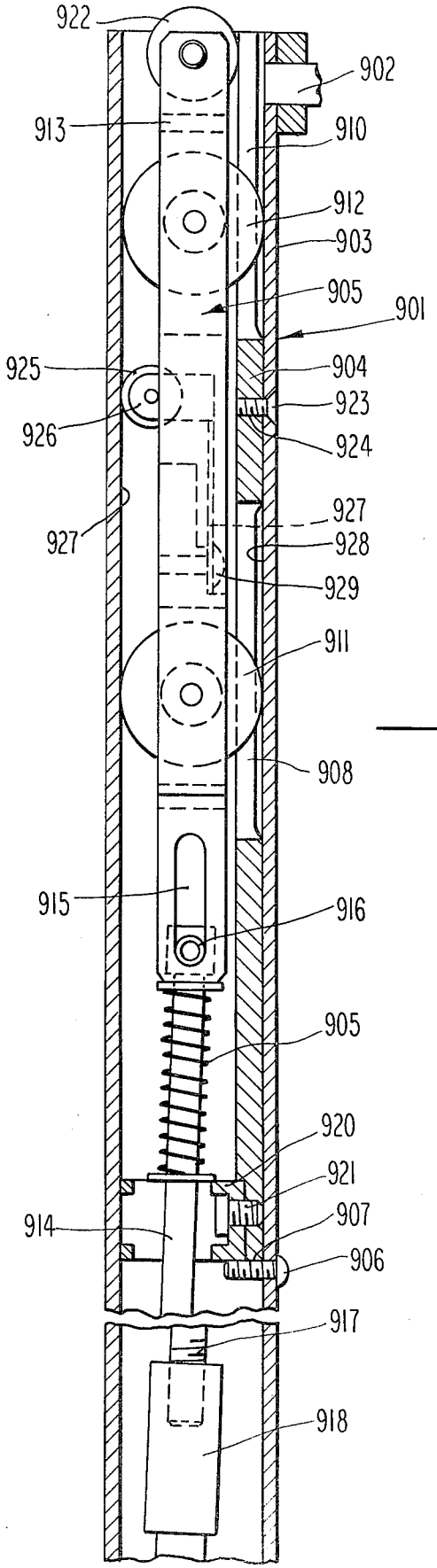
FIG. 9 is a vertical sectional view of still another embodiment of a panic handle, taken along a line similar to that III—III of FIG. 1.

With particular reference to the embodiment illustrated in FIG. 9, it will be seen that a panic bar assembly 901, is constructed generally for mounting at its upper end by means of a ball shaft 902 which facilitates pivoting at the upper end, in the normal manner aforesaid.

Inside sleeve 903, is a bolt housing guide 904 carrying a bolt mechanism 905 for vertical upward and downward movement therein as viewed in FIG. 9. The bolt housing guide 904 is spring-urged by means of compression spring 905 against a round-headed screw 906 at its lower end as shown at 907, with screw 906 providing a stop against undesirable further inward movement of the guide 904, into the sleeve 903.

The guide 904 is provided with a pair of slotted holes 908 and 910 that act as guideways for rollers 911 and 912 upwardly and downwardly therein as bolt member 913 is moved outwardly of, or back into the sleeve 903, into latched and unlatched positions thereof. The two rollers 91 and 912 thus roll in engagement against interior surface portions of the sleeve 903, as illustrated in FIG. 9. The bar 914 is slidable at its upper end in slotted hole 915 in the bolt 913, by means of a slidable pin arrangement 916, and at its lower end is in threaded engagement by means of threaded portions 917 screwed into a complimentary threaded member 918.

A collar 920 is secured to the lower end of guide 904 by means of threaded connector 921, as shown, with the collar 920, bar 914, bolt 913, wheels 911 and 912, and all other components carried by the bar 913, being rotatable together, within the sleeve 903, by grasping the upper end of bar 913, and/or the bolt wheel 922 at its upper end, and rotating the same within the sleeve 903, such that the lower end of the bar 917 is threaded more deeply, or the converse, into or out of further engagement in member 918. The effect of such rotation of the bolt mechanism in the sleeve, is to allow a field adjustment by means of an unskilled mechanic or the like, of the amount of extension of the bolt into its latch, for facilitating proper field adjustment. It will be understood that the slotted holes 908 and 910 are sufficiently long to allow any reasonable desired amount of adjustment of the type aforesaid, and still provide sufficient track for guidance of the wheels 911, 912 therein.

It will also be understood that a screw or like threaded member 923, normally connects the track 904 and the sleeve 903 together, against relative movement, but that, if the track 904 and bolt 913 are to be adjusted relative to the sleeve 903, it is simply necessary to remove the screw 923, and to rotate the track 904 and bolt 913 one or more complete turns, such that the threaded hole 924 in track 904 comes into alignment with the opening in sleeve 903 for the screw 923, upon which event the screw 923 may again be inserted, locking the track and sleeve together once again.

It will thus be seen that a simple and efficient adjustment feature is provided for use in the field, upon The present invention also employs a new anti-rattle and sound deadening feature, in the form of a spring-mounted anti-rattle wheel 925, mounted for rotation in yoke 926, with yoke 926 being mounted on and carried by the upper end of a spring finger 927, which spring finger 927 is disposed inside bolt 913, being mounted thereto, by means of an appropriate connector member 929 at its lower end, as shown in FIG. 9, thereby securing the lower end of the spring finger 927 fixedly to the bolt 913. However, the upper end of the spring finger 927, and the yoke and wheel 925 caried thereby are able to be moved leftward and rightward, as viewed in FIG. 9, such that the spring serves to urge the wheel 925, against the left inner wall 927 of the sleeve 903, at the same time urging the wheels 911 and 912 against the right interior wall 928 as viewed in FIG. 9, thereby providing a mechanism for preventing rattling of the latch bolt mechanism inside the sleeve while at the same time deadening any rattle sounds that might otherwise be effected by slight vibration of the door upon which the panic bar is mounted, or otherwise. Accordingly, during opening and closing, or upon slight forces being applied to a door, such as may be caused by wind or the like, undesirable rattling and sounds caused thereby are prevented, in addition to providing a smooth and efficient latching and unlatching of the bolt mechanism inside the bar, while obviating the necessity for use of other wheels and/or guides in connection with the bolt mechanism.

This preferred embodiment of the invention comprises an "L" shaped panic bar assembly as illustrated. This illustrated panic bar assembly is particularly striking when used on a glass door assembly in conjunction with a fixed exterior handle as shown. It will be understood that other configurations of the panic handle assembly, such as straight handles (pivoted at only one end); "U" shaped handles (pivoted at two ends); and "L" shaped handles with varying length straight sections may be employed without departing from the nature of this invention.

What is claimed is:

1. A door and panic handle combination comprising bar means mounted on and extending from a location along an edge of the door to a location inwardly thereof, substantially parallel to the door; said bar means having a means for engagement by a user at the inward location thereof; latch means concealingly housed inside the bar means and terminating in a latch bolt at said location along the edge of the door; with the bar being mounted for limited pivotal movement toward and away from said door between latched and unlatched positions thereof.

2. The door and panic handle of claim 1, including adjustable mounting means mounting the latch bolt inside the bar for facilitating adjustably positioning the terminal end latch bolt relative to an associated end of the bar.

3. The door and panic handle of claim 1, wherein anti-rattle means are provided inside the bar for preventing latch means from rattling therein.

4. The door and panic handle of claim 3, wherein said anti-rattle means include spring means for urging guide wheels for the latch means carried inside the bar against the wheel tracks.

* * * * *

UNITED STATES PATENT AND TRADEMARK OFFICE

CERTIFICATE OF CORRECTION

PATENT NO. : 4,418,949

DATED : Dec. 6, 1983

INVENTOR(S) : William J. Horgan, Jr.

It is certified that error appears in the above-identified patent and that said Letters Patent is hereby corrected as shown below:

The term of this patent subsequent to January 4, 2000 has been disclaimed.

Signed and Sealed this

*Sixth* Day of *March 1984*

[SEAL]

*Attest:*

GERALD J. MOSSINGHOFF

*Attesting Officer*

*Commissioner of Patents and Trademarks*